US012434159B2

(12) United States Patent
Sainton et al.

(10) Patent No.: US 12,434,159 B2
(45) Date of Patent: Oct. 7, 2025

(54) ATTRACTION, METHOD FOR IMPLEMENTING SAME, COMPUTER PROGRAM AND COMPUTER-READABLE MEDIUM

(71) Applicant: ALTERFACE HOLDINGS, Wavre (BE)

(72) Inventors: Etienne Sainton, Schaerbeek (BE); Stéphane Battaille, Bousval (BE)

(73) Assignee: ALTERFACE HOLDINGS, Wavre (BE)

( * ) Notice: Subject to any disclaimer, the term of this patent is extended or adjusted under 35 U.S.C. 154(b) by 506 days.

(21) Appl. No.: 18/005,350

(22) PCT Filed: Jul. 15, 2021

(86) PCT No.: PCT/EP2021/069852
§ 371 (c)(1),
(2) Date: Jan. 12, 2023

(87) PCT Pub. No.: WO2022/013394
PCT Pub. Date: Jan. 20, 2022

(65) Prior Publication Data

US 2023/0311009 A1 Oct. 5, 2023

(30) Foreign Application Priority Data

Jul. 16, 2020 (BE) ..... 2020/5533

(51) Int. Cl.
*A63G 5/00* (2006.01)
*A63G 1/24* (2006.01)
*A63G 33/00* (2006.01)

(52) U.S. Cl.
CPC ..... *A63G 5/00* (2013.01); *A63G 1/24* (2013.01); *A63G 33/00* (2013.01)

(58) Field of Classification Search
None
See application file for complete search history.

(56) References Cited

U.S. PATENT DOCUMENTS 5,127,657 A * 7/1992 Ikezawa ..... A63F 9/0291 434/21
5,716,281 A * 2/1998 Dote ..... F41J 9/14 463/2
6,220,965 B1 * 4/2001 Hanna ..... A63G 7/00 463/52

(Continued)

FOREIGN PATENT DOCUMENTS

CA 2999518 A1 * 9/2018 ..... A63G 21/22
CN 207694242 U 8/2018
WO 2019/147416 A1 8/2019

OTHER PUBLICATIONS

International Search Report for PCT/EP2021/069852 (Oct. 12, 2021).

*Primary Examiner* — Dorothy Harris
(74) *Attorney, Agent, or Firm* — Merchant & Gould P.C.

(57) ABSTRACT

An attraction that includes interactive targets, a plurality of vehicles capable of moving between a plurality of fixed positions. The vehicles are configured to convey participants of the attraction. Transmitters fitted to the vehicles are for interacting with the targets. In the fixed positions of the vehicles, the transmitters of a pair of vehicles interact with the same target.

16 Claims, 5 Drawing Sheets

(56) References Cited

U.S. PATENT DOCUMENTS

| | | | | |
|---|---|---|---|---|
| 6,796,908 | B2 * | 9/2004 | Weston | A63G 7/00 472/60 |
| 8,128,476 | B1 * | 3/2012 | Sidhu | A63F 3/00643 463/16 |
| 9,943,759 | B2 * | 4/2018 | Boyle | A63G 25/00 |
| 10,279,274 | B1 | 5/2019 | Brister et al. | |
| 10,843,092 | B2 * | 11/2020 | Hall | A63G 31/00 |
| 2006/0293110 | A1 * | 12/2006 | Mendelsohn | A63G 1/00 472/137 |
| 2007/0089630 | A1 * | 4/2007 | Gordon | A63G 7/00 104/53 |
| 2008/0125230 | A1 * | 5/2008 | Rowe | A63F 9/02 463/52 |
| 2013/0145953 | A1 * | 6/2013 | Crawford | B61J 1/10 104/35 |
| 2018/0280789 | A1 * | 10/2018 | Laidlaw | A63F 9/0291 |
| 2019/0224579 | A1 * | 7/2019 | Hall | A63G 31/16 |
| 2023/0114639 | A1 * | 4/2023 | Jennings | A63G 31/02 701/24 |

* cited by examiner

ATTRACTION, METHOD FOR IMPLEMENTING SAME, COMPUTER PROGRAM AND COMPUTER-READABLE MEDIUM

This application is a National Stage Application of PCT/EP2021/069852, filed Jul. 15, 2021, which claims benefit of Patent Application No. 2020/5533, filed Jul. 16, 2020 in Belgium, and which applications are incorporated herein by reference. To the extent appropriate, a claim of priority is made to each of the above-disclosed applications.

TECHNICAL FIELD

The present invention relates to an attraction, a method for implementing the attraction, a computer program and a computer-readable medium.

PRIOR ART

There is an attraction called "laser game" in which groups of participants on foot form two teams in a large dark room and shoot lasers at each other. One of the goals is for the teams to hit the participants of the other team as many times as possible.

The disadvantage of such an attraction is that the flow of participants is low because the number of people per team is limited. In addition, the attraction takes place in a large room with obstacles. Such an attraction is therefore bulky with respect to the low flow of participants. In addition, the participants tend to run around in the dark room, which is dangerous because the participants can collide and injure themselves.

There is therefore a need for an attraction that is less bulky and has a higher flow of participants.

SUMMARY OF THE INVENTION

To this end, the invention proposes an attraction comprising:

- interactive targets,
- a plurality of vehicles capable of moving between several fixed positions, the vehicles being intended to convey participants of the attraction,
- transmitters fitted to the vehicles for interacting with the targets,
- in the fixed positions of the vehicles, the transmitters of a pair of vehicles interacting with the same target.

The invention relates to an attraction comprising interactive targets and a plurality of vehicles capable of moving between several fixed positions. The vehicles are intended to convey participants of the attraction. The vehicles are equipped with transmitters to interact with the targets. In the fixed positions of the vehicles, the transmitters of a pair of vehicles interact with the same target. A group of participants from a certain vehicle activates the transmitters to interact with a target that is the same as another group of participants in another vehicle; the attraction allows for a large number of participants to be loaded into the vehicles in order to promote the flow of participants while allowing for a less bulky attraction. Furthermore, the implementation of the invention is not expensive. Another advantage is that there is no downtime as everyone plays at the same time.

In the attraction, each vehicle conveys a team of participants. When a participant plays a game in the attraction, while remaining in the same vehicle, he/she participates in several rounds, each round corresponding to a fixed position and a different team of opponents. Between rounds, he changes his fixed position and his team of opponents.

It is possible, while remaining within the scope of the invention, that the transmitters of more than two vehicles interact with the same target in each fixed position. In particular, if X is the number of vehicles, the transmitters of which interact with the same target in each fixed position, X is an integer greater than 1, preferably equal to 2 or 3, and the number of vehicles in the attraction is equal to X times the number of targets.

The movements of the vehicles are controlled by a computer program, which preferably runs on a computer system that is part of the attraction (although not necessarily located within the enclosure of the attraction).

According to one embodiment, the participants of one vehicle are visible to the participants of the other vehicle of the pair of the vehicles in the fixed position of the vehicles.

In each fixed position of the vehicles, each vehicle forms a pair with a different vehicle. This allows the teams of opponents to be varied for a tournament.

According to one embodiment, the vehicles are capable of moving in rotation and/or translation.

In one embodiment, the attraction comprises supports each supporting at least two vehicles, the supports being capable of moving in rotation and/or translation between the fixed positions of the vehicles. The supports simplify the implementation of movements of vehicles. The number of vehicles per support is preferably equal to 2 or 3. Indeed, with only one vehicle, the flow of the attraction would be low, and with four or more vehicles, the angles could be too small for a good distribution on the targets.

According to one embodiment, the attraction comprises three supports, each support having two vehicles, preferably the attraction comprises four supports, each support having three vehicles.

According to one embodiment, the attraction further comprises a platform that is mobile in rotation, driving the supports and vehicles.

According to one embodiment, the targets are screens displaying images to be intercepted with the transmitters. The images are preferably controlled via a computer program running on the computer system.

According to one embodiment, the targets are screens arranged around an area of movement of the vehicles and/or at a height relative to the vehicles.

The invention further provides a method for implementing an attraction, comprising the steps of:

- moving the vehicles to a fixed position,
- in the fixed position of the vehicles, activating the transmitters of a pair of vehicles by the participants of those vehicles to interact with the same target,
- repeating the above steps.

The method preferably corresponds to participation in the attraction.

According to one embodiment, there are at least two fixed positions in which the participants activate the transmitters to interact with different targets.

In each fixed position of the vehicles, the vehicles form pairs with a different vehicle. In this way, the teams change opponent teams between each fixed position.

In one embodiment, the vehicles take at least three fixed positions, preferably four fixed positions. Thus, each game on the attraction comprises at least three or four rounds.

The invention further provides a program comprising the instructions that cause the attraction to perform the steps of the method according to one of the claims, and a computer-readable medium, on which said program is recorded.

The use in this document of the verb "comprise", its variants, as well as its conjugations, can in no way exclude the presence of elements other than those mentioned. The use in this document of the indefinite article "a", "an", or the definite article "the", to introduce an element does not exclude the presence of a plurality of these elements.

The terms "first", "second", "third", etc. are used in this document exclusively to differentiate between different elements, without implying an order between these elements.

All of the preferred embodiments and all of the advantages of the attraction according to the invention apply mutatis mutandis to the method for implementing the attraction, the computer program and the computer-readable medium—and vice versa.

BRIEF DESCRIPTION OF THE FIGURES

Further features and advantages of the present invention will become apparent from the following detailed description, for the understanding of which reference is made to the attached figures, among which.

Figure 1:
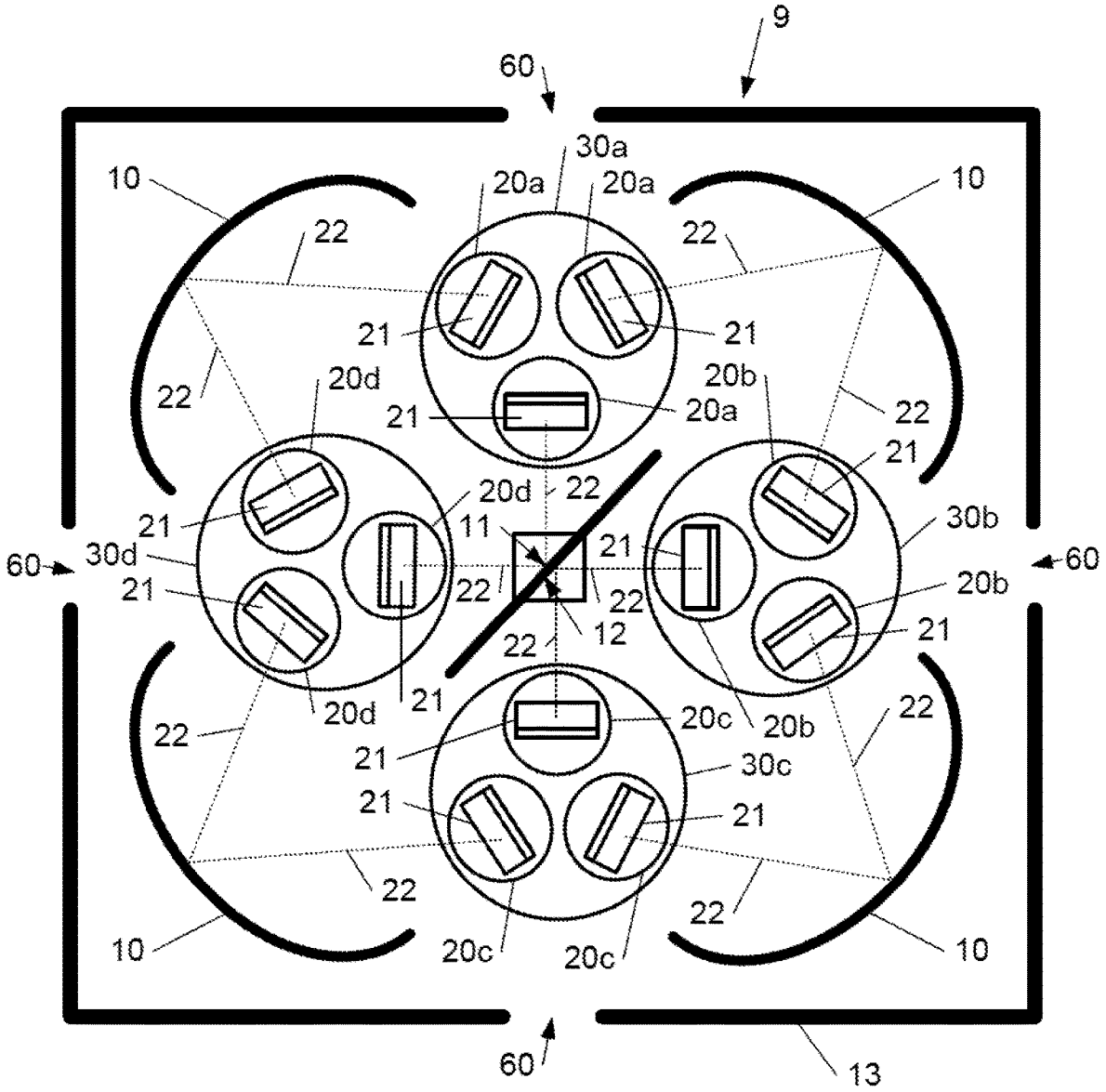
FIG. 1 illustrates a schematic view of the attraction.

The drawings in the figures are not to scale. Similar elements are generally denoted by similar references in the figures. For the purposes of this document, the same or similar elements may bear the same references. Furthermore, the presence of reference numbers or letters in the drawings cannot be considered limiting, even when such numbers or letters are indicated in the claims.

DETAILED DESCRIPTION OF EMBODIMENTS OF THE INVENTION

This section provides a detailed description of preferred embodiments of the present invention. The present invention is described with particular embodiments and references to figures, but the invention is not limited thereby. In particular, the drawings or figures described below are only schematic and are not limiting.

FIG. 1 shows a schematic view of the attraction. The attraction 9 comprises interactive targets 10, 11, 12. A plurality of vehicles 20 are capable of moving between a number of fixed positions; the vehicles 20 convey the participants of the attraction. In the fixed positions, the vehicles, and therefore the participants, face the targets in order to interact with the target. The vehicles 20 are equipped with transmitters (visible in FIG. 5) which the participants activate to interact with the targets along the lines 22. In a fixed position as seen in FIG. 1, a pair of vehicles are facing the same target and the transmitters of these two vehicles interact with this target by activation by the participants carried by these two vehicles.

Figure 2:
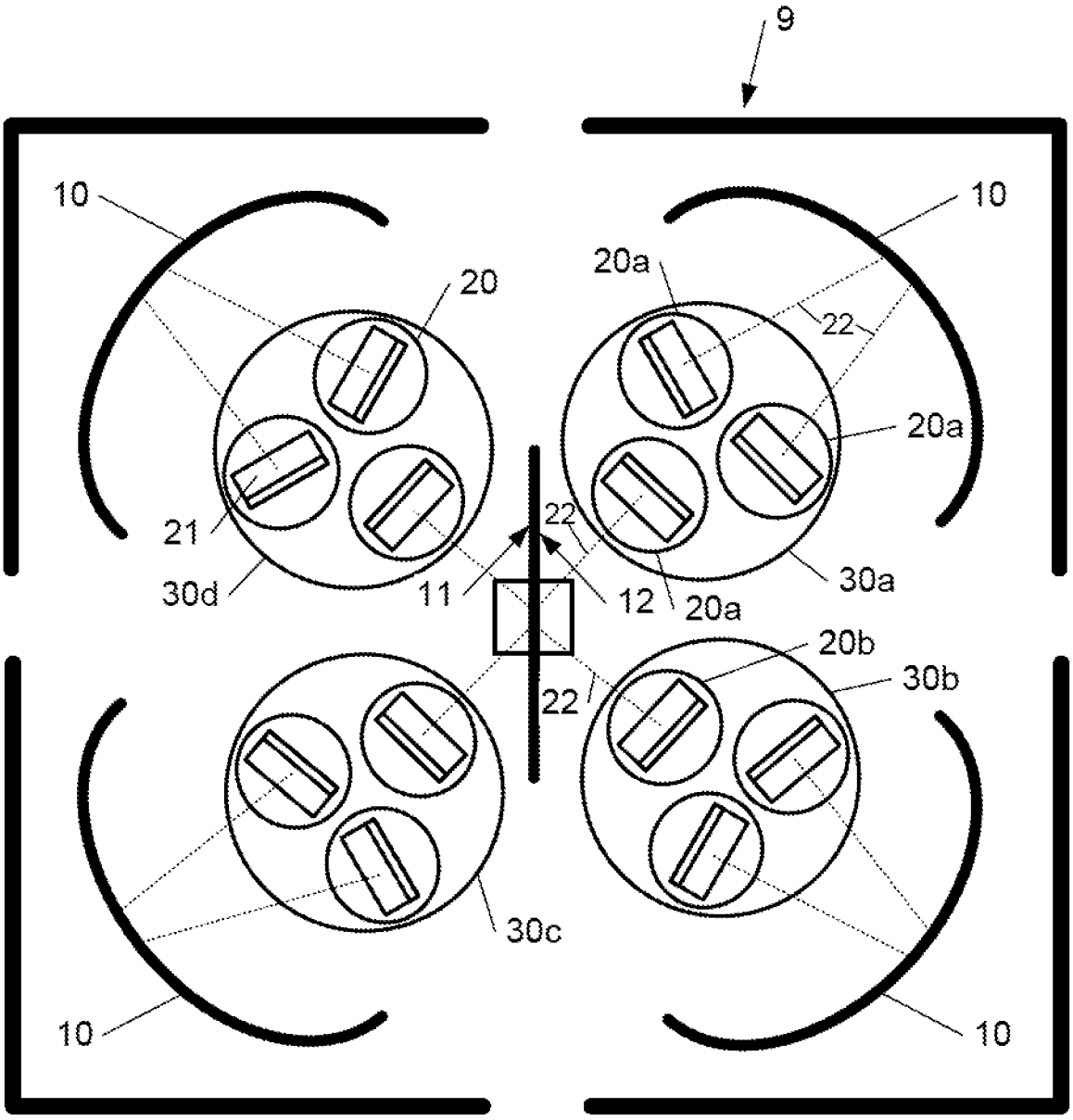
FIG. 2 illustrates another schematic view of the attraction.
Figure 3:
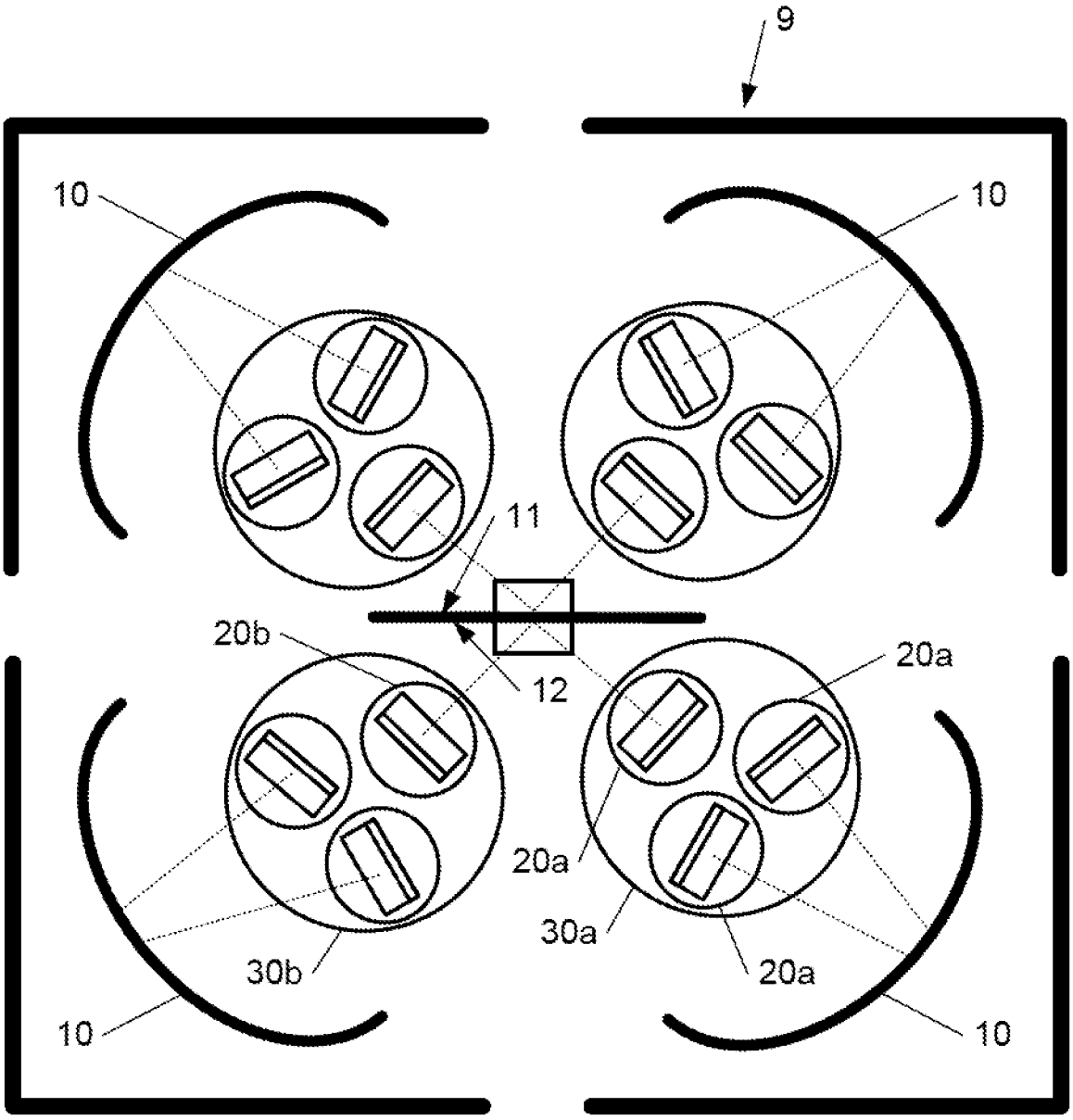
FIG. 3 illustrates another schematic view of the attraction.
Figure 4:
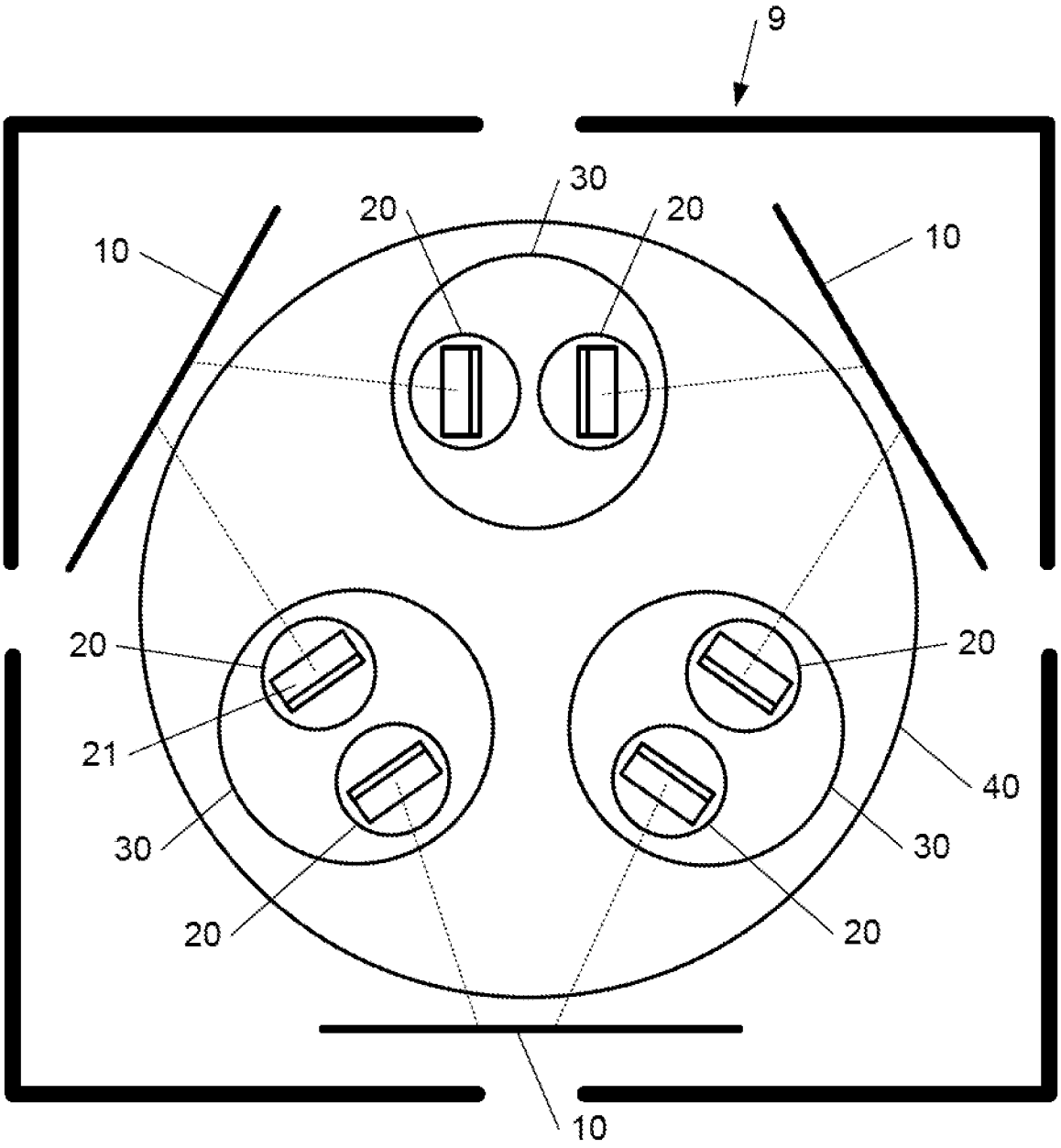
FIG. 4 illustrates another schematic view of the attraction.
Figure 5:
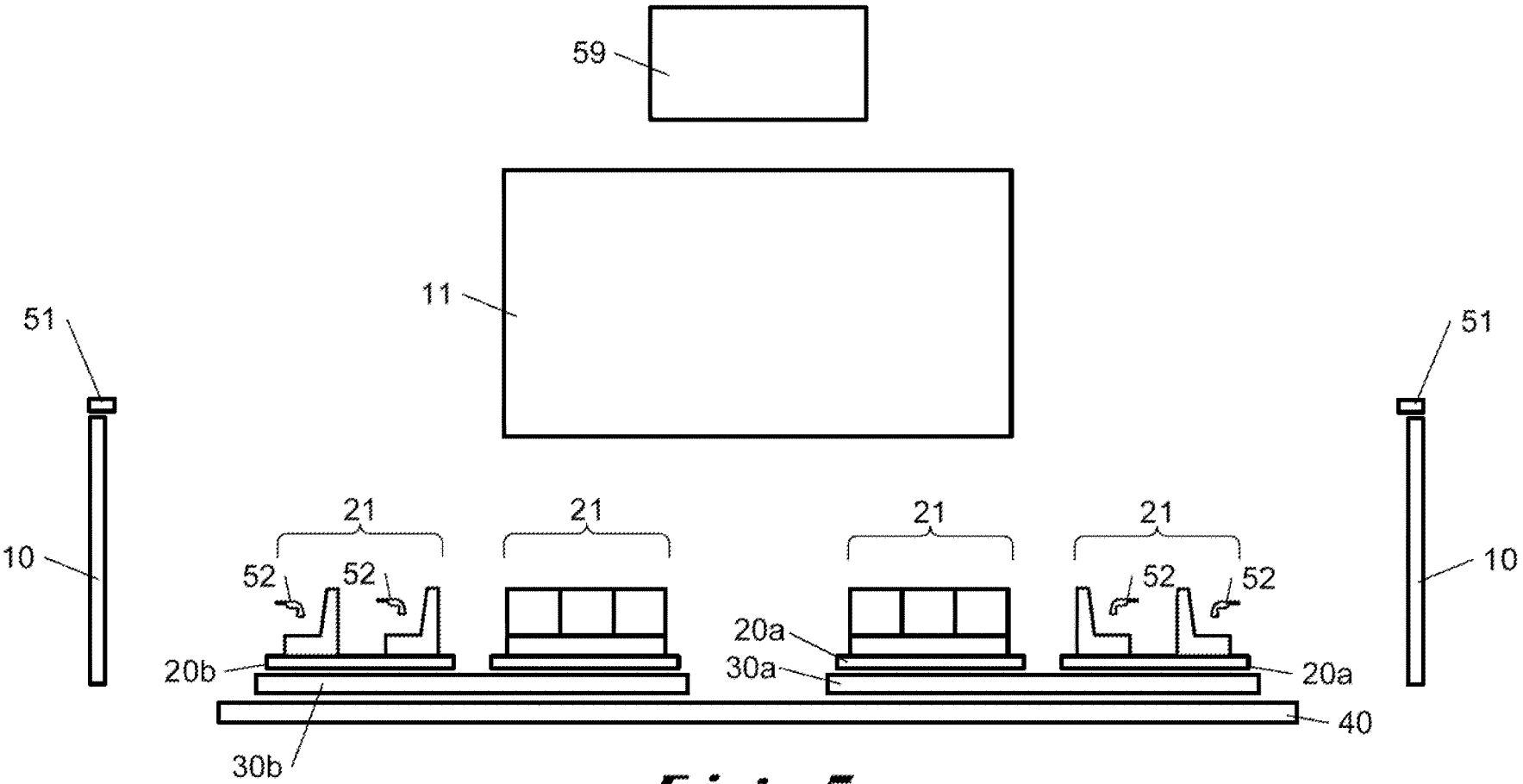
FIG. 5 illustrates a cross-sectional view of the attraction.

The goal of the attraction is for the participants to hit as many targets as possible 10, 11, 12. The targets 10, 11, 12 can be screens on which images such as animations or large LCD or plasma screens—for example 6 metres long—are projected. The animations can be two-dimensional or three-dimensional to make the attraction more exciting. The participants can wear 3D glasses. As shown in FIGS. 1-3, the screens can be concave to increase the area of projection. This enhances the experience of the participants. As shown in FIG. 4, the screens can also be flat, to reduce their space requirement and facilitate the installation. The targets can be arranged around the area of movement of the vehicles as in the case of the targets 10 in FIG. 1; this allows for large target sizes. The targets 10 can be at different heights to give a surprise effect to the participants. The targets 11, 12 are in the centre of the area of movement of the vehicles to provide additional target positioning. The targets 11, 12 may be attached to the platform 40 or to the ceiling. Preferably, the targets 11, 12 are at a height with respect to the vehicles, vertically to the centre of the area of movement, as seen in FIG. 5, thereby reducing the space requirement of the attraction on the ground without impeding movement of the vehicles. The targets 11, 12 are on each side of a central screen. A combination of the arrangement of the targets 10, 11, 12 allows the interest of the attraction to be varied, without disrupting the movement of the vehicles or increasing the space requirement of the attraction. The targets 10, 11, 12 can be immobile which facilitates their installation; the targets 10, 11, 12 can also be mobile to increase the interaction angles of the transmitters handled by the participants. For example, the targets 11, 12 can be rotated on themselves as can be seen in FIGS. 1 to 3.

The vehicles 20 are mobile in the sense that their position and location vary during the attraction. The mobility of the vehicles between two fixed positions allows to offer different targets to the participants, which increases the interest of the attraction. The movement of the vehicles between two fixed positions is random. Even though the movement can be programmed in advance, the movement is unpredictable by the participants and is different when moving from a fixed position to a new fixed position. This allows to disorientate the participants. The mobility of the vehicles is ensured by rotation on themselves; the advantage is that in the same location in the attraction, the vehicle can offer several angular positions to allow the interaction with various targets. In addition, the rotational movement disorients the participants. The mobility can also be provided in translation; this allows for varying the distance to targets and interaction with various targets. Alternatively, we can consider a mobility that is a combination of rotation and translation to achieve all the advantages mentioned.

The vehicles 20 reach fixed positions after a move. The positions are fixed in the sense that the movement of the vehicles 20 stops. The immobility of the vehicles then enables the participants to interact with the targets 10, 11, 12 using the transmitters 52. The plurality of fixed positions allows the targets with which participants interact to be varied—in particular, by providing different settings for different targets or by providing targets with different positions (for example, around or above the vehicles) to capture the attention of participants.

In the fixed positions of the vehicles, the transmitters 52 of a pair of vehicles interact with the same target. For example, in the lower right-hand corner of FIG. 1, a vehicle 20*b* and a vehicle 20*c* form a pair, the transmitters of which may interact with the same target 10 along the lines 22. For example, the same applies to two vehicles 20*b* and 20*a*, in the upper right-hand corner of FIG. 1, forming a pair and interacting with the same target 10 (potentially different from the previous one) along the lines 22. In the centre of FIG. 1, two vehicles 20*b* and 20*c* form a pair, the transmitters of which can interact with the same target 12 along the lines 22. Interacting with the same target allows participants forming a team on one vehicle to compete with other participants forming another team on another vehicle. This allows duels to take place between several teams while avoiding participants colliding with each other and injuring themselves.

The participants of a vehicle 20 are visible to the participants of the other vehicle 20 of the pair of vehicles in the fixed position of the vehicles. For example in FIG. 1, the participants of the pairs of vehicles 20*b*, 20*c* (bottom right) or 20*a*, 20*b* (top right) or 20*d*, 20*a* (centre) can see each other. This stimulates the participants' willingness to interact with the targets.

It is conceivable that in each fixed position, the transmitters 52 of each vehicle are interacting with the same target. After moving, the vehicles can then return to the same location. The pairs of vehicles then remain the same, the same participants compete during the attraction. The animation on the same target can then be expected to vary.

Preferably, in each fixed position of the vehicles 20, the transmitters 52 of the vehicles interact with a different target. This makes the attraction more exciting, as the participants wonder during the movement of the vehicle which location will be reached. In addition, in each fixed position, the vehicles form a pair with a different vehicle; this allows participants on one vehicle to compete with some or all of the other participants on the other vehicles. A tournament is thus organised between the vehicles, which takes place in successive rounds at each fixed position. In this way, the participants are confronted with more teams without increasing the space requirement of the attraction.

The attraction 9 may further comprise supports 30*a*, 30*b*, 30*c*, 30*d* each supporting at least two vehicles 20. The supports 30 may be trays, for example 8 metres in diameter. The supports are capable of moving in rotation and/or translation between the fixed positions of the vehicles 20. In other words, the supports 30 drive the vehicles 20 in motion towards their fixed positions. The supports 30 allow the movement of groups of vehicles, thus increasing the possible movements and fixed positions of the vehicles and thus the possibility of pairs of vehicles interacting with the targets.

According to FIG. 4, the attraction may further comprise a platform 40 driving the supports 30 and the vehicles 20 to the fixed positions. The platform 40 is mobile in rotation. Such a platform facilitates the assembly of the attraction. The supports 30 may be mobile in rotation and/or translation mounted on the platform, thereby increasing the possible movements of the vehicles 20. The platform may be present on the attraction of FIGS. 1-3. The platform has for example a diameter of 20 metres.

The number of vehicles is not limited. FIGS. 1-3 show twelve vehicles 20 on four supports 30. In the fixed positions shown, two vehicles on each support face a target 10 at the periphery of the area of movement. The last vehicle on each support faces a central target 11 or 12, preferably located above the vehicles. FIG. 4 shows six vehicles on three supports 30. The vehicles all face the peripheral targets 10. In the fixed position shown, a pair of vehicle facing the same target 10 at the periphery of the area of movement is formed by a vehicle on two different supports 30.

The movement of the vehicles is a combination of the vehicles' own movement (rotational and/or translational) and the movement of the supports (rotational and/or translational). Preferably, the vehicles 20 are mobile in rotation on the supports 30, the supports themselves being rotatable. Thus, the movement of the vehicles is a combination of two rotational movements which increases the possible movements of the vehicles.

The vehicles 20 have individual stations to accommodate the participants and ensure their safety during the attraction. According to FIG. 5, the stations are chairs 21 to ensure the comfort and stability of the participants; they can also be benches. The chairs 21 or benches may be arranged in two rows as can be seen for the vehicle 20*b* on the left of the Figure or 20*a* on the right of the Figure. Belts or harnesses ensure the safety of the participants. They can also be standing stations, which allows more participants to be put on a vehicle. The vehicles are for example 3 metres long. The vehicles can vibrate or tilt to further enhance the participants' experience.

FIG. 5 shows the transmitters 52. The transmitters 52 provide interactivity with the targets 10, 11, 12 and allow participants to score points when the targets are correctly hit. In particular, the participants seek to intercept the images displayed on targets with the transmitters 52. Preferably, the transmitters 52 are only active in fixed positions of the vehicles 20 in order to avoid shooting during the movement of the vehicles. Also the transmitters of one vehicle can interact only with the target 10, 11, 12 shared with the other vehicle of the pair. This avoids firing at other targets and thus altering the results. The transmitters 52 allow the pressure of the game to build up between the participants once in their hands. The transmitters 52 are easy to hold, even with the rapid movement, in particular, in rotation, of the vehicles 20. The transmitters 52 are easy to use, even if the participants have chairs with high backs in front of them. The transmitters 52 are for example laser pointers and are for example in the form of a gun. Cameras 51 are used to detect the signal from the transmitters. The cameras 51 can be positioned on top of the targets.

A status of the scores per participant and/or per vehicles is available in real time on a screen 59 visible in FIG. 5. The screen 59 is for example above the vehicles and visible to all the participants. A screen outside the attraction is possible to allow remote monitoring of the attraction. The vehicles may have on-board displays providing the ranking and individual score as the game progresses. At the end of the game, the participants can collect a statistics sheet. Screens outside the attraction may also display player statistics, as well as high scores for the day and/or since the attraction was commissioned.

The attraction 9 comprises an enclosure 13 in which the darkness reigns during the duration of the attraction. The participants of the pairs of vehicle in the positions are able to see each other through the brightness of the targets or through lighting effects. The occupation or the evacuation of the attraction is done simultaneously by the participants, i.e., not sequentially. This reduces the downtime between each use of the attraction. Accesses 60 at the entrance and exit are provided. The entrances 60 are arranged around the area of movement of the vehicles so as to allow such occupancy and egress. In FIGS. 1-4, four exits are provided as examples. To occupy (or evacuate) the vehicles, the participants approach the vehicle closest to the exit. At the end of the attraction, the supports and vehicles are stopped to allow for the evacuation and subsequent occupation by the participants in an efficient manner. In FIGS. 1-3, the accesses 60 are opposite the supports 30; in FIG. 4, the vehicles are stopped in a position such that the path between the vehicles 20 and the accesses is as short as possible. It is also possible to consider that some accesses 60 are for entry into the attraction only and others for exit only.

The enclosure 13 may be decorated to give participants a sense of a sporting event. Screens can be used to show trailers. A boxing match atmosphere can be reproduced with fan cheers, bright lights and music. The audio tapes, the lights, a screen displaying the results, increasing speeds of the vehicles contribute to a playful increase in pressure on the participants.

The invention also relates to a method for implementing the attraction 9. During the method, the vehicles 20 are moved to a fixed position; in this position, the participants of a pair of vehicles activate the transmitters 52 to interact with the same target. In the fixed positions, the vehicles, and thus the participants, face the targets in order to interact with the target. The method then repeats these steps a predefined number of times.

FIGS. 1-3 show the alternation of the steps of the method.

In FIG. 1, the supports 30 supporting the vehicles 20 are at the four cardinal points. In this fixed position of the vehicles, the transmitters 52 of a first vehicle 20*a* interact along the line 22 with the same peripheral target 10 as the transmitters 52 of a first vehicle 20*d* of the pair, at the top left of FIG. 1; the transmitters 52 of a second vehicle 20*a* interact along the line 22 with the same peripheral target 10 as the transmitters 52 of a first vehicle 20*b* of the pair, at the top right of FIG. 1. At the centre of the attraction, the transmitters 52 of a third vehicle 20*a* interact along the line 22 with the same central target 11 as the transmitters 52 of a second vehicle 20*d* of the pair. In FIG. 1, the vehicles 20 of each support form a pair with a vehicle of another support.

In FIG. 2, the vehicles have been moved to a new fixed position, such that the supports are offset by approximately 45°. The displacement of the supports 30 and the vehicles 20 may be greater than simply shifting the supports by 45°. The vehicles 20 and the supports 30 may move for several seconds or minutes in a random motion to arrive at the position in FIG. 2. In FIG. 2, the transmitters 52 of a first and second vehicle 20*a* of the same support 30*a* interact along the line 22 with the same peripheral target 10 at the top right of FIG. 2. In the centre of the attraction, the transmitters 52 of a third vehicle 20*a* interact along the line 22 with the same central target 11 as the transmitters 52 of a vehicle 20*b* of the pair. In FIG. 2, two vehicles 20 of a single support 30 form a pair, with the third vehicle 20 of the support forming a pair with the vehicle of another support 30. In addition, in FIG. 2, it can be seen that the central targets 11, 12 have rotated on themselves to provide different angles of interaction with the transmitters 52.

In FIG. 3, the vehicles have been moved to a new fixed position, such that the supports are offset by approximately 45°. Again, the displacement of the supports 30 and the vehicles 20 may be greater than simply shifting the supports by 45°. The vehicles 20 and the supports 30 may move for several seconds or minutes in a random motion to arrive at the position in FIG. 3. At the centre of the attraction, the transmitters 52 of a first vehicle 20*a* interact along the line 22 with the same central target 12 as the transmitters 52 of a vehicle 20*b* of the pair. In FIG. 3, the transmitters 52 of a second and third vehicles 20*a* of the same support 30*a* interact along the line 22 with the same peripheral target 10, at the bottom right of FIG. 3. In FIG. 3, two vehicles 20 of the same support 30 form a pair, with the third vehicle 20 of the support forming a pair with the vehicle of another support 30. In addition, in FIG. 3, it can be seen that the targets 11, 12 have again rotated on themselves to provide different angles of interaction with the transmitters 52.

The speed of movement of the vehicles can be constant or increasing to increase the interest of the game.

Preferably, the participants activate the transmitters 52 to interact with a different target in each fixed position of the vehicles. This increases the interest of the attraction. Also, in these fixed positions, the vehicles form pairs with a different vehicle, allowing participants of one vehicle to compete with different participants during the method of implementing the attraction.

The method can be implemented by starting with the fixed position and activating the transmitters and then a moving step or conversely by a moving step to reach a fixed position. The vehicles are repeatedly in a fixed position, a variable number of times predefined before the attraction is launched. This is determined in advance by the organiser of the attraction according to the time of each stage and the number of visitors to the attraction. The attraction can therefore be easily adapted to different implementations. In each fixed position, the vehicles preferably form a pair with a different vehicle, which increases the number of duels between different teams without increasing the space requirement of the attraction. For example, the organiser can arrange for the vehicles to be in a fixed position at least three times to give participants several opportunities to interact with the targets; preferably the vehicles are in a fixed position four times. With three or four fixed positions, the vehicles preferably form a pair with a different vehicle, thus increasing the number of duels between different teams without increasing the space requirement of the attraction.

The invention also relates to a computer program comprising instructions that cause the attraction to perform the described steps of the method. The program may include several scenarios in which the number of fixed positions varies according to parameters such as attendance, desired duration of the steps of the method, etc. Also, the programme allows the atmosphere within the enclosure to be changed. The invention also relates to a computer-readable medium on which this program is recorded.

The present invention has been described in relation to specific embodiments, which are purely illustrative and should not be considered limiting. In general, it will be apparent to one skilled in the art that the present invention is not limited to the examples illustrated and/or described above.

The invention claimed is:

1. An attraction comprising:

a plurality of vehicles capable of moving between a plurality of fixed positions, the vehicles being configured to convey participants of the attraction;

interactive targets, transmitters fitted to the vehicles for interacting with the targets;

wherein, in the fixed positions of the vehicles, the transmitters of a pair of vehicles interact with the same target;

and wherein in each fixed position of the vehicles, each vehicle forms a pair with a different vehicle.

2. The attraction according to claim 1, wherein the participants of one vehicle are visible to the participants of the other vehicle of the pair of the vehicles in the fixed position of the vehicles.

3. The attraction according to claim 1, wherein the transmitters are laser pointers.

4. The attraction according to claim 1, wherein the vehicles are capable of moving in rotation and/or translation.

5. The attraction according to claim 1, comprising supports each supporting at least two vehicles, the supports being capable of moving in rotation and/or translation between the fixed positions of the vehicles.

6. The attraction according to claim 5, comprising three of the supports, each of the supports having two vehicles.

7. The attraction according to claim 5, wherein the attraction comprises four supports, each support having three vehicles.

8. The attraction according to claim 1, further comprising a platform mobile in rotation, driving the supports and the vehicles.

9. The attraction according to claim 1, wherein the targets are screens displaying images to be intercepted with the transmitters.

10. The attraction according to claim 1, wherein the targets are screens arranged around an area of movement of the vehicles and/or at a height with respect to the vehicles.

11. A method for implementing an attraction according to claim 1, comprising the steps of:

moving the vehicles to a fixed position so that, in each fixed position of the vehicles, the vehicles form pairs with a different vehicle, in the fixed position of the vehicles, activating the transmitters of a pair of vehicles by the participants of those vehicles to interact with the same target, repeating the previous steps.

12. The method according to claim 11, comprising at least two fixed positions in which the participants activate the transmitters to interact with different targets.

13. The method according to claim 11, wherein in each fixed position of the vehicles, the transmitters of one vehicle interact only with the target shared with the other vehicle of the pair.

14. The method according to claim 10, wherein the vehicles take at least three fixed positions.

15. The method according to claim 11, wherein the vehicles take four fixed positions.

16. A non-transitory computer program comprising instructions that cause the attraction according to claim 1 to perform the steps of a method comprising:

moving the vehicles to a fixed position so that, in each fixed position of the vehicles, the vehicles form pairs with a different vehicle, in the fixed position of the vehicles, activating the transmitters of a pair of vehicles by the participants of those vehicles to interact with the same target, repeating the previous steps.

* * * * *